US007334551B2

(12) United States Patent
Pattullo

(10) Patent No.: US 7,334,551 B2
(45) Date of Patent: Feb. 26, 2008

(54) COMBUSTION ENGINE PULL CORD START SYSTEM

(75) Inventor: George M. Pattullo, Caro, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 0 days.

(21) Appl. No.: 11/414,423

(22) Filed: Apr. 28, 2006

(65) Prior Publication Data

US 2007/0251484 A1 Nov. 1, 2007

Related U.S. Application Data

(63) Continuation-in-part of application No. 11/285,554, filed on Nov. 25, 2005, and a continuation-in-part of application No. 11/059,038, filed on Feb. 16, 2005, and a continuation-in-part of application No. 10/951,149, filed on Sep. 27, 2004, now abandoned.

(51) Int. Cl.
*F02M 1/02* (2006.01)
*F02N 3/02* (2006.01)

(52) U.S. Cl. ..... 123/179.18; 123/185.3

(58) Field of Classification Search ..... 123/185.4, 123/185.3, 185.2, 701, 198 D, 396, 400, 123/179.18; 180/335; 60/906; 261/35, 261/52

See application file for complete search history.

(56) References Cited

U.S. PATENT DOCUMENTS 3,361,124 A * 1/1968 Fend ..... 123/185.4
4,257,367 A * 3/1981 Fujikawa et al. ..... 123/185.4
5,500,159 A * 3/1996 Martinsson ..... 261/52
5,927,241 A 7/1999 Dahlberg et al.
2006/0065224 A1* 3/2006 Pattullo ..... 123/179.18
2006/0070594 A1* 4/2006 Pattullo ..... 123/179.18
2006/0180113 A1* 8/2006 Pattullo ..... 123/179.18

FOREIGN PATENT DOCUMENTS

DE 40 16 224 A1 11/1991
DE 4016224 A1 * 11/1991
DE 19618699 A1 * 11/1997
EP 1640592 A 3/2006
GB 1051828 12/1966
JP 03 121267 5/1991

* cited by examiner

*Primary Examiner*—Stephen K. Cronin
*Assistant Examiner*—Ka Chun Leung
(74) *Attorney, Agent, or Firm*—Reising, Ethington, Barnes, Kisselle, P.C.

(57) ABSTRACT

A pull-cord start system has a recoil pulley coupled to a crankshaft of a combustion engine and a pull-cord wound about the recoil pulley which is pulled by an end user to rotate the recoil pulley and thereby start the engine. A throttle override device of the pull-cord start system has a shuttle coupled to the pull-cord for movement from a biased rest position to an active position when the pull-cord is being pulled by an end user. A linkage of the throttle override device which is preferably a Bowden cable extends between a throttle control and a throttle valve of a carburetor and is associated with the shuttle so that actuation of the throttle control when the shuttle is in the active position will not open the throttle valve which preferably is biased to an idle position because movement of the shuttle to the active position produces slack in the linkage.

18 Claims, 5 Drawing Sheets

COMBUSTION ENGINE PULL CORD START SYSTEM

CROSS-REFERENCE TO RELATED APPLICATIONS

This is a continuation-in-part of U.S. patent application, Ser. No. 10/951,149, filed on Sep. 27, 2004 now abandoned, U.S. patent application, Ser. No. 11/059,038, filed on Feb. 16, 2005, and U.S. patent application, Ser. No. 11/285,554, filed Nov. 25, 2005.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

BACKGROUND OF THE INVENTION

1. Field of the Invention

The present invention relates generally to a combustion engine start system and more particularly to a pull-cord start system for an engine.

2. Description of Related Art

For many decades small internal combustion engines, such as those used for recreational vehicles and landscaping tools like chain saws, trimmers, tractors, and lawn mowers, have typically used mechanical, manually-operated recoil pull-starters. In a direct recoil pull-starter, an operator of the vehicle or garden tool pulls a cord that is wound about a recoil pulley to rotate the recoil pulley in a first direction. The rotating recoil pulley rotates an engine crankshaft, via a one-way coupling, to start a combustion engine. The one-way coupling allows the crankshaft of the running engine to rotate freely relative to the recoil pulley. When the cord is released by the operator, the recoil pulley automatically reverses rotation, by way of a torsional recoil spring, to retract the cord back around the recoil pulley.

In the past, small engines were designed to start at wide open throttle (WOT) however, current small engines are designed to start at idle. Unfortunately, the end users are accustomed to holding down or depressing the throttle trigger to place the throttle valve in the WOT position even for the idle start engines. Retraining the end user to not hold down the throttle trigger while attempting to start the engine is difficult. In fact, even though new engines are not designed to start with the throttle lever fully depressed, the product of the engine application is returned to the manufacturer because the engine will not easily or reliably start at WOT.

Moreover, when the engine is running and a throttle trigger is fully depressed, ideally, the throttle valve of a carburetor is at WOT. This requires close tolerances that can be expensive to manufacture. If the tolerances are off, the throttle trigger may not be fully depressed when the throttle valve is at WOT and further movement of the trigger can place undue stress upon the linkage components. If the throttle trigger is fully depressed before the throttle valve reaches WOT, the engine will not operate at its full power potential.

BRIEF SUMMARY OF THE INVENTION

A pull-cord start system has a recoil pulley coupled to a crankshaft of a combustion engine and a pull-cord wound about the recoil pulley that is pulled by an end user to rotate the recoil pulley and thereby start the engine. A throttle override device of the pull-cord start system has a shuttle coupled to the pull-cord for movement from a biased rest position to an active position when the pull-cord is being pulled by an end user. A linkage preferably including a Bowden cable extends between a throttle control and a throttle valve of a carburetor and is operably associated with the shuttle so that actuation of the throttle control when the shuttle is in the active position will not open the throttle valve which preferably is biased to its idle position.

When the engine is running, the shuttle is preferably biased into the rest position by a tension spring engaged between a housing and a trailing end of the shuttle. A cable at an unsheathed portion of the Bowden cable preferably loops about a tensioner of the shuttle between opposing open ends of first and second sheaths of the Bowden cable held generally stationary to the housing. When the engine is being started, the pull-cord is pulled, and the throttle control is not actuated, the shuttle moves to the active position but does not carry the cable with it. If the engine is being started after the throttle control is actuated placing the biased closed throttle valve in an unduly WOT position, pulling the pull-cord will move the throttle valve back to the idle position as the shuttle moves toward the active position due to available slack created in the cord.

Preferably, the pull-cord start system also has an auxiliary device that shares the shuttle to actuate other attributes of an engine-driven apparatus. Preferably, the auxiliary device is a start assist device having a linkage engaged between the shuttle and a choke valve of the carburetor to hold the biased open choke valve substantially closed during starting of the engine and automatically releasing the choke valve after the engine starts.

At least some of the objects, features and advantages that may be achieved by at least certain embodiments of the invention include providing an engine that starts reliably (at idle) has a simplified start-up procedure that overrides a throttle lever only during start-up, automatically actuates various startup elements of an engine-powered apparatus, reduces or eliminates engine stalling on overly rich mixtures of fuel-and-air during engine startup, automatically places a choke valve in partially open positions upon engine startup and automatically returns the choke valve to an "off" or fully open position after the engine has successfully started, is of relatively compact construction, simple design, low cost when mass produced, rugged, durable, reliable, requires little to no maintenance and adjustment in use, and in service has a long useful life.

BRIEF DESCRIPTION OF THE SEVERAL VIEWS OF THE DRAWINGS

These and other objects, features and advantages of this invention will be apparent from the following detailed description of the preferred embodiments and best mode, appended claims, and accompanying drawings in which:

DETAILED DESCRIPTION OF THE INVENTION

Figure 2:
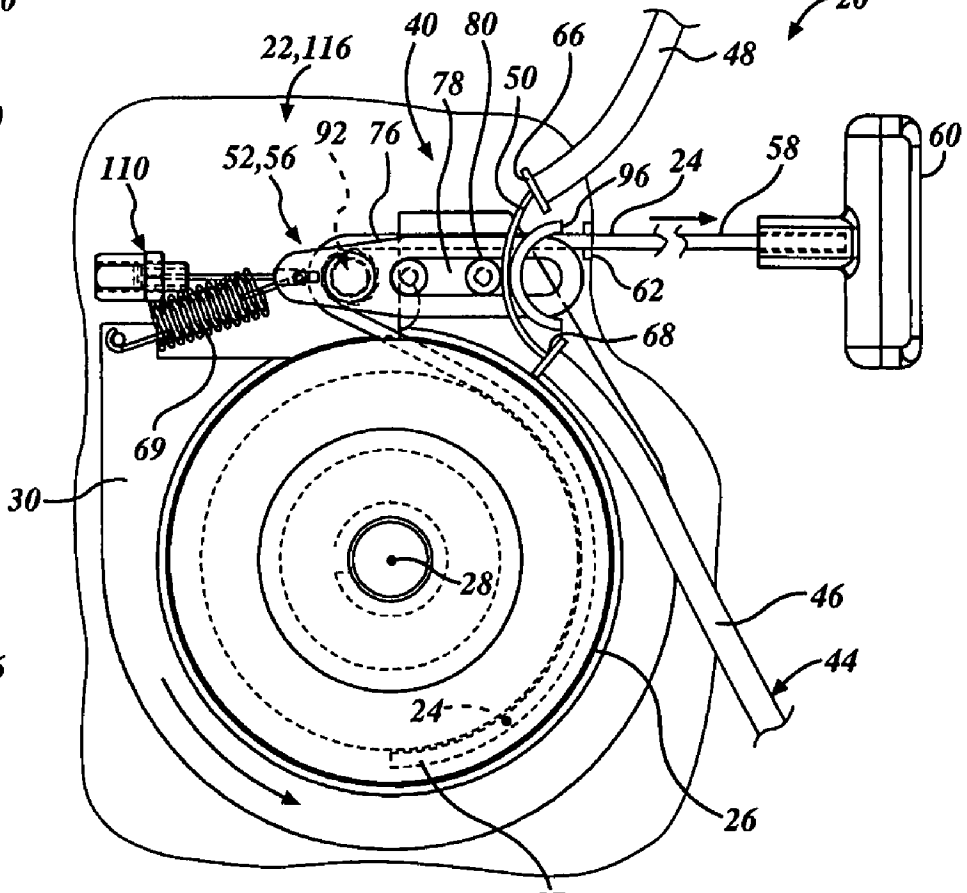
FIG. 2 is a fragmentary view of the pull-cord start system with the throttle override device illustrated in an active position, and the recoil starter assembly illustrated in a pulled state.
Figure 1:
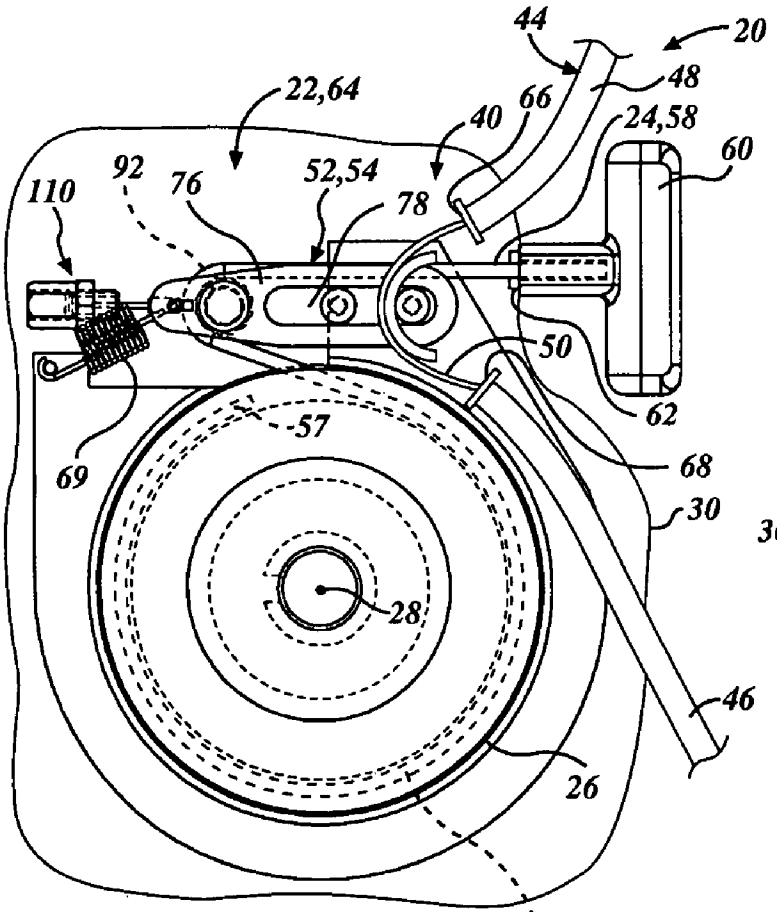
FIG. 1 is a fragmentary view of a combustion engine pull-cord start system embodying the present invention and having a throttle override device illustrated in a rest position, and a recoil starter assembly illustrated in a recoiled state.

Referring in more detail to the drawings, FIGS. 1-2 illustrate a pull-starter or pull-cord start system 20 of the present invention preferably utilized on small displacement internal combustion engines constructed and arranged to be started at or near engine idle speed. The pull-cord start system 20 has a manual pull-cord recoil starter assembly 22 having a pull-cord 24 that when pulled by an operator against a rotational bias of a pulley or spindle 26 rotates a crankshaft of the engine about a rotation axis 28 and at a speed sufficient to start the engine. The pulley 26 is preferably surrounded by a stationary housing 30 and coupled to the crankshaft by a one-way clutch (not shown) that drives the crankshaft as the pull-cord 24 is pulled and permits the crankshaft to freely rotate relative to the pulley 26 when the engine is running.

Figure 3:
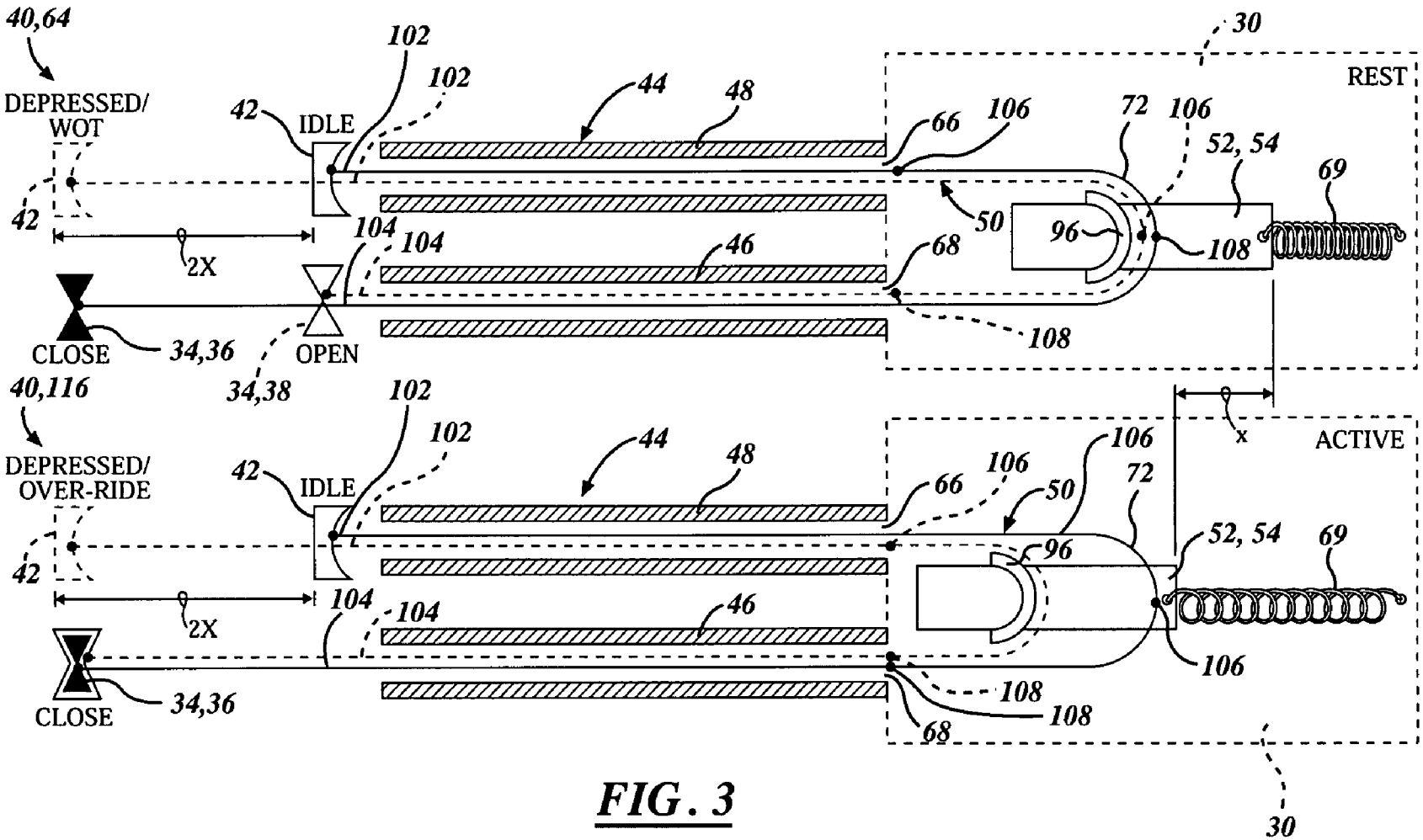
FIG. 3 is a diagrammatic view of the throttle override device illustrating the effects of actuating a throttle trigger of the pull-cord start system when the device is in the rest position verses the active position.
Figure 5:
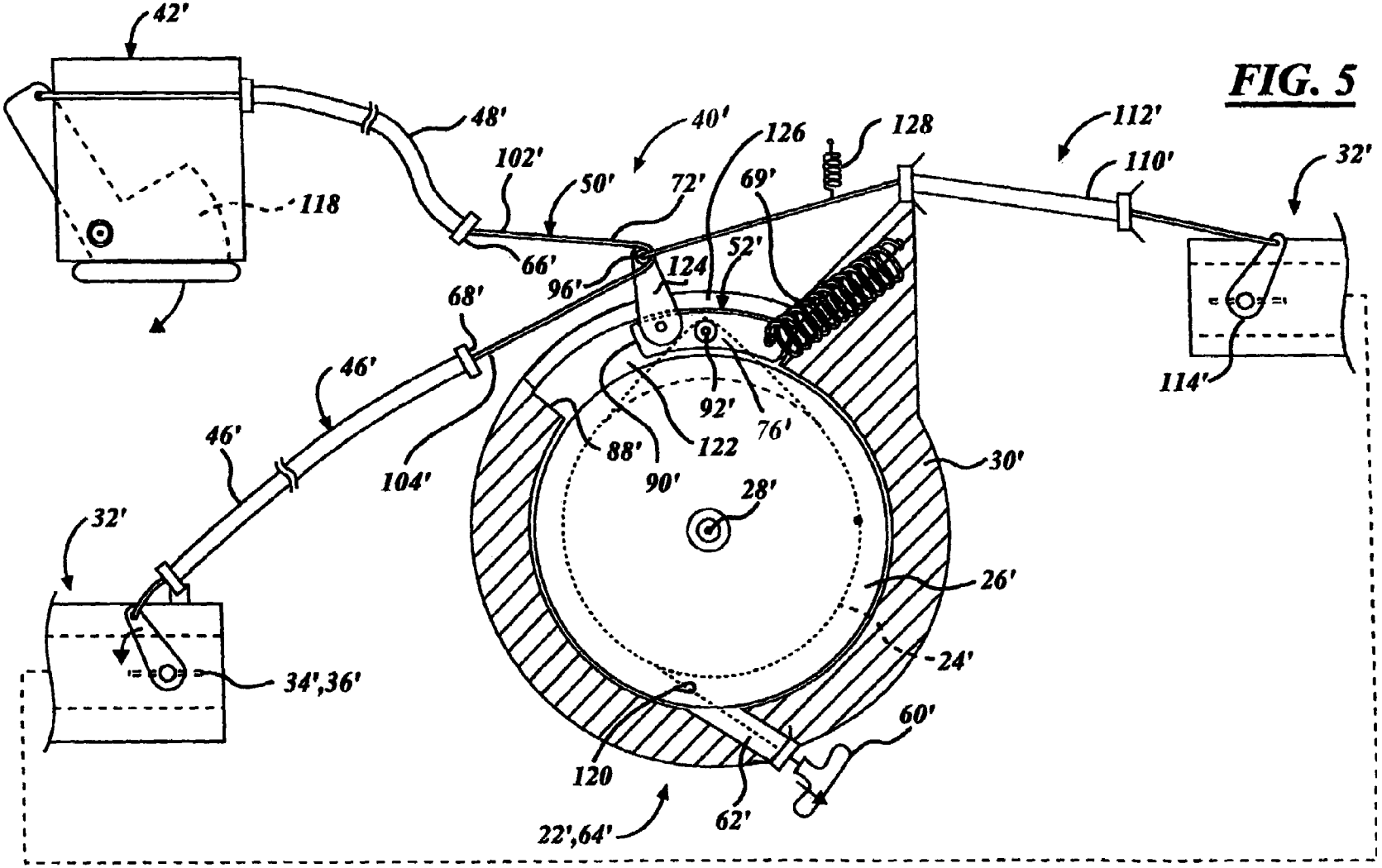
FIG. 5 is a combined partial section view of a pull-cord start system having a throttle override device that shares a modified shuttle with a start assist device, and illustrating the shuttle in the rest position.

The engine is preferably used for applications such as chainsaws, leaf blowers, and the like that typically receive a mixture of fuel and air from a carburetor 32 having a biased closed throttle valve 34 that moves between a substantially closed or idle position 36 (see FIGS. 3 and 6) and a wide open throttle position 38 (see FIGS. 3 and 5). Because the engine is designed to start at or near idle speed, a throttle override device 40 of the pull-cord start system 20 prevents movement of the throttle valve 34 toward the wide open position 38 when starting and if an end user inadvertently actuates a remote throttle control 42. For actuation, the throttle control 42 is linked to the throttle valve 34 by a mechanical linkage or Bowden cable 44 of the throttle override device 40.

The Bowden cable 44 preferably has a first hollow tube or sheath 46 held generally stationary between the carburetor 32 and the housing 30 of the recoil starter assembly 22, and a second hollow tube or sheath 48 spaced longitudinally or separated from the first sheath 46 and held generally stationary between the throttle control 42 and the housing 30. An elongate member or flexible cable 50 of the Bowden cable 44 is linked between the throttle valve 34 and the throttle control 42 so that actuation of the throttle control 42 generally causes the cable 50 to slide in the first and second sheaths 46, 48 when the pull-cord 24 is not being pulled by the end user to start the engine. Between the first and second sheaths 46, 48, the cable 50 engages a dampener member or shuttle 52 of the throttle override device 40 that is supported by the housing 30 and moves with respect to the housing 30 via interaction with the pull-cord 24. The shuttle 52 is in a biased rest position 54 (see FIG. 1) when the pull-cord 24 of the of the recoil starter assembly 22 is not being pulled and moves toward an active position 56 (see FIG. 2) when the pull-cord 24 is being pulled.

Preferably, the pull-cord 24 attaches to the pulley 26 at a base end 57 and extends, while wrapping around the pulley 26 in a counter-clockwise direction, to a distal end 58 connected to a handle 60 accessible from outside the housing 30 at a passage 62 through which the pull-cord 24 extends for consistent circumferential orientation of where the pull-cord 24 departs from the pulley 26 during any given time of operation of the recoil starter assembly 22. When the recoil starter assembly 22 is in a fully wound recoiled state 64, the handle 60 is preferably slightly biased against the housing 30 by the biasing force of the recoil spring (not shown) of the recoil starter assembly 22.

After winding about the pulley 26 in a counter-clockwise direction, the pull-cord 24 preferably loops in a clockwise direction about the shuttle 52 generally adjacent to the distal end 58 and before the pull-cord 24 exits the passage 62 in the housing 30. When the throttle override device 40 is in the rest position 54 and the recoil starter assembly is in a recoiled state 64, the shuttle 52 is located at its farthest point (i.e. the rest position 54) from the handle 60 and generally from opposing open ends 66, 68 of the respective first and second sheaths 46, 48. The shuttle 52 is yieldably biased to its rest position 54 by a coiled tension spring 69 attached between the housing 30 and the shuttle 52. Because the shuttle 52 is required to substantially remain in the rest position 54 during normal throttle control 42 operation and after starting the engine, the tension spring 69 has a sufficient spring force to resist movement of the shuttle 52 via any residual recoil force of the coil spring (not shown) of the recoil starter assembly 22. One skilled in the art would now know that rotational directions and orientations are merely described as reflected in FIGS. 1 and 2 and can be reversed.

Figure 4:
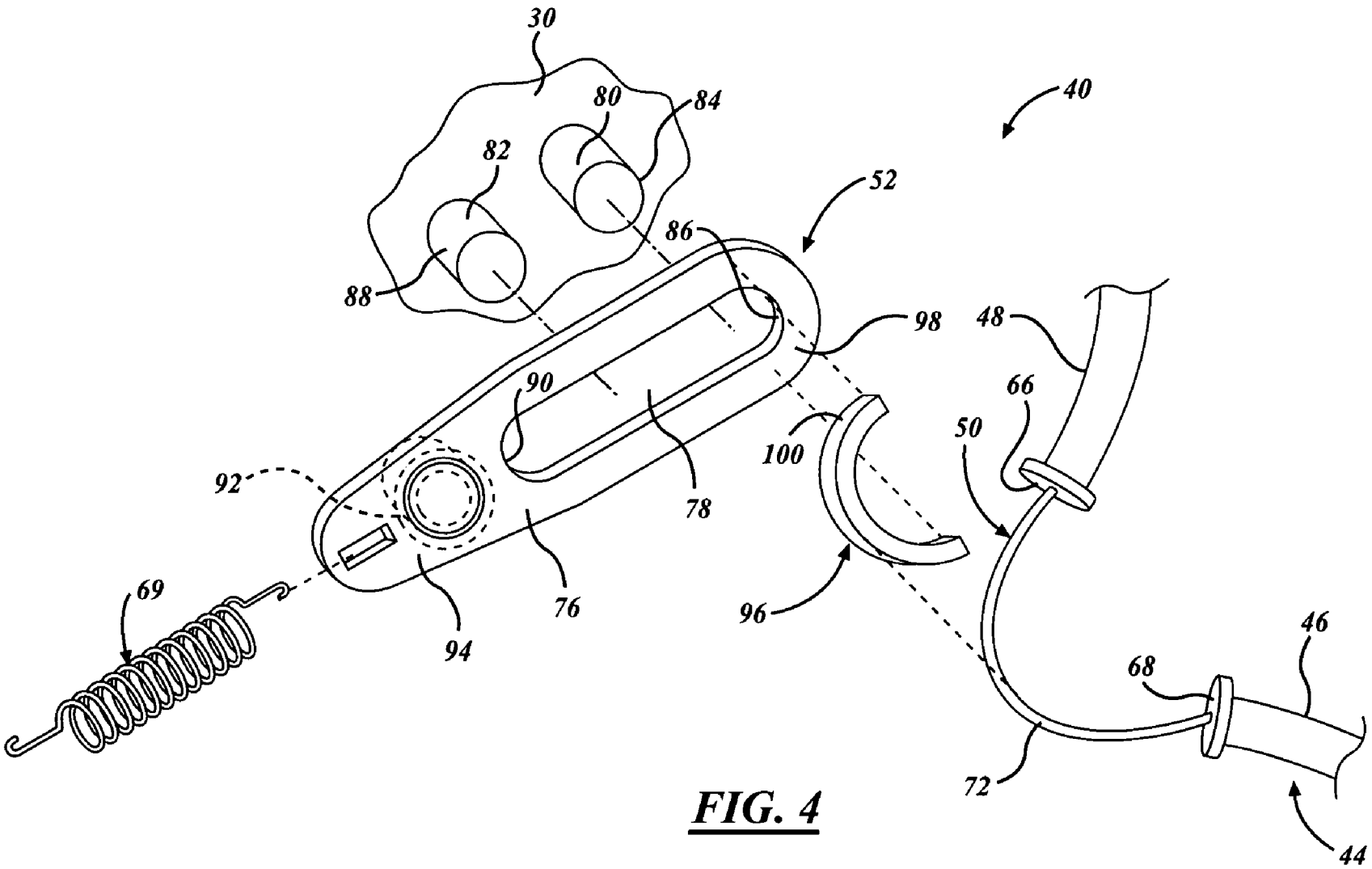
FIG. 4 is a partial exploded perspective view of the throttle override device illustrating a shuttle of the throttle override device.

As best illustrated in FIG. 4, the shuttle 52 has a body 76 with a substantially linear slot 78 that in the embodiment shown extends substantially tangentially with respect to the pulley 26. The housing 30 includes a substantially cylindrical rest boss 80 and an active boss 82 that are spaced apart and both project rigidly and axially with respect to axis 28 from the housing 30 and into the slot 78 to limit sliding movement of the shuttle 52 relative to the housing 30. The rest boss 80 provides a rest stop 84 that contacts a stop end 86 of the slot 78 when in the rest position 54 and the active boss 82 provides an active stop 88 that contacts an opposing stop end 90 at the opposite end of the slot 78. The distance between stops 84, 88 relative to the distance between stop ends 86, 90 generally defines the distance or throw of shuttle travel between the rest and active positions 54, 56. One skilled in the art would now know that the rest and active bosses 80, 82 could be one boss extending longitudinally between the stops 84, 88 and laterally through the slot 78; the bosses could be carried by the shuttle 52 and the slot could be in the housing 30; or any other suitable arrangement.

The pull-cord 24 preferably loops about a spindle or pin 92 of the shuttle 52 journaled for rotation to the body 76. The pin 92 projects axially outward from the body 76 and is substantially parallel to the axis of the pulley 26 for clear or unobstructed receipt of the pull-cord 24. Preferably, the pin 92 is mounted to a trailing end 94 of the body 76 connected to the tension spring 69 and nearer the active stop end 90 of the slot 78. Conversely, a slack or mid-segment 72 of the throttle cable 50 loops about a cable tensioner or protrusion 96 of the shuttle 52 in substantially the same or matching circumferential position (i.e. three o-clock position as illustrated in FIGS. 1 and 2) as the pull-cord 24 about the pin 92. The cable tensioner 96 projects outward in a perpendicular direction from a leading end 98 of the body 76 near the stop end 86 of the slot 78 and open ends 66, 68 of the sheaths 46, 48. The tensioner 96 preferably has a convex surface 100 that prevents kinking of cable 50 and substantially faces the stop end 90 of shuttle 52.

Figure 6:
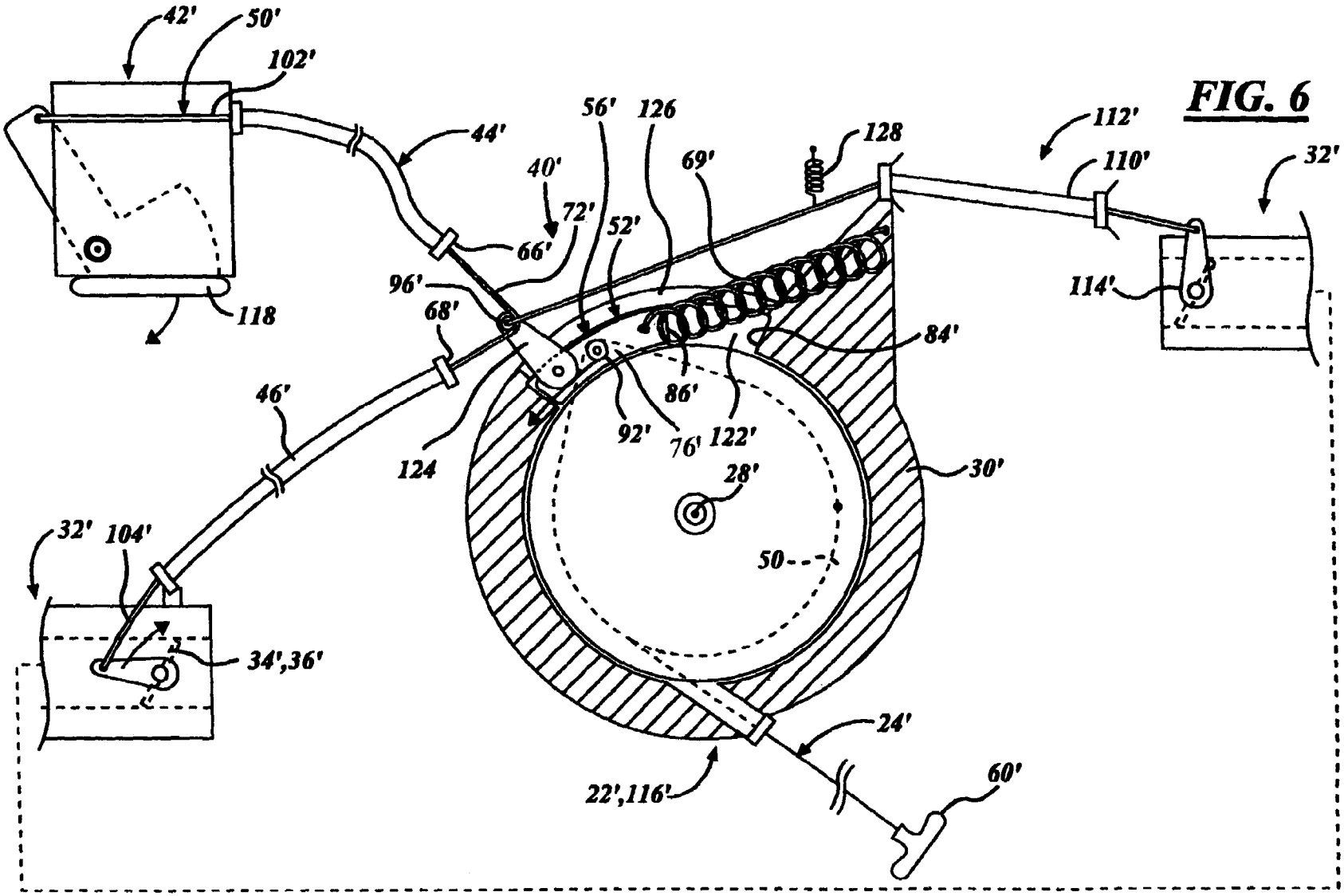
FIG. 6 is a combined partial section view of the pull-cord start system of FIG. 5 illustrating the modified shuttle in the active position.

As best illustrated in FIGS. 1-2, the pull-cord start system 20 preferably has a second Bowden cable or linkage 110 connected to the trailing end 94 of the shuttle body 76 for operation of an auxiliary device 112 that functions during starting of the engine. Such auxiliary devices can preferably function to assist in starting the engine. For instance, the auxiliary device can substantially close a choke valve 114 of the carburetor 32 during engine starting (as best shown in FIGS. 5-6), or may actuate/open a pressure relief valve communicating with a combustion chamber of the engine (not shown). Patent application Ser. No. 11/285,554, filed Nov. 21, 2005, further discloses such devices, is assigned to the same assignee of the present invention, and is incorporated herein by reference in its entirety.

When starting the engine, the operator manually grasps the handle 60 attached to the pull-cord 24 and pulls the pull-cord 24 outward from the housing 30. This turns or rotates the pulley 26 in a counter-clockwise direction (as viewed in FIG. 2) against the bias of the torsion spring (not shown) generally engaged between the pulley 26 and the housing 30. The operator must pull the pull-cord with sufficient strength to overcome the bias of the pulley recoil spring that would otherwise cause the pull-cord 24 to rewind back into the housing 30 within a circumferential groove carried by the pulley 26 and opening generally radially outward. As the pull-cord 24 is pulled outward toward an unwound state 116 (as best illustrated in FIG. 2) the recoil pulley 26 engages with the crankshaft of the engine causing the piston(s) to reciprocate with sufficient speed to start the engine. When the pull-cord 24 is released by the operator, the recoil spring (not shown) causes the pulley 26 to rotate clockwise through a series of complete revolutions. Because the base end 57 of the pull-cord 24 is connected to the pulley 26, the pull-cord 24 travels with or rewinds on the pulley and recoils back into the housing 30 until the handle 36 nestles or seats against the housing 30 proximate to the passage 62, thus placing the recoil starter assembly 22 into the recoiled state 64, as best illustrated in FIG. 1 wherein the dampener member or shuttle 52 is in its rest position.

When the recoil starter assembly 22 is in the recoiled state 64, the shuttle 52 is in the rest position 54 hence the tension spring 69 is not under substantial tension. However, because a residual force of the recoil spring is preferably biasing the pulley 26 in a clockwise direction that in turn through the pull-cord 24 biases the shuttle 52 toward the active position 56, the tension spring 69 preferably resists this residual force to maintain the shuttle 52 substantially in the rest position 54. One skilled in the art would now understand that if the recoil spring of the pulley 26 had no remaining recoil force left after recoiling the pull-cord 24 but before the handle 60 is snugly against the housing 30, the tension spring 69 could be utilized to exert a biasing force that places the handle 60 against the housing 30. That is, the tension spring 69 can be used to take up any slack of the pull-cord 24 when the recoil starter assembly 22 is generally in the recoiled state 64.

As best illustrated in FIGS. 3 and 5-6, when the engine is running and the end user desires to accelerate the engine, the throttle control 42 is actuated preferably by a pivoting trigger 118 that moves the cable 50 by a distance or throw of (2×) wherein (x) is the distance that the shuttle 52 moves between the rest and active positions. When the cable 50 moves with respect to both sheaths 46, 48, by throw (2×) the shuttle 52 remains substantially stationary and the throttle valve 34 opens against the biasing force of a throttle spring (not shown). So that the shuttle 52 remains substantially stationary, the strength of the tension spring 69 is generally greater than the strength of the throttle spring that biases the throttle valve toward its idle position 36 plus any residual recoiling force of the pulley's recoil spring (not shown) acting on the shuttle. Also when the engine is running, the shuttle 52 preferably acts to dampen movement between the throttle control 42 and the throttle valve 34 near fully actuated positions. For instance, if the trigger 118 is not fully actuated or seated against a physical stop at the instant the throttle valve reaches its wide open throttle position 38, or the trigger is generally out of sync with the throttle valve, the shuttle 52 will move or be extended slightly against the bias of the tension spring 69, thus preventing undue stress upon the cable 50 and throttle valve 34 due to operator exertion upon the trigger 118. That is, if the throw of the trigger 118 is slightly greater than the throw of the throttle valve 34 or simply out of sync, slight movement of the shuttle 52 can make up for the difference between throws.

During engine starting, the pulling force placed upon the handle 60 by the end user overcomes both the pulley recoil spring force and the force of the tension spring 69. As previously described and although the force of tension spring 69 is preferably greater than the residual force on the shuttle 52 of the pulley recoil spring, the recoil spring force that exerts a tension upon the pull-cord 24 increases as the pulley 26 is rotated counter-clockwise with pulling of cord 24 and exceeds the resistive force of the tension spring 69. When exceeded, the shuttle 52 shifts to the active position 56 placing slack in the cable 50 that overrides any unintended depression of the throttle trigger 118 to close the throttle valve 34. The shuttle 52 preferably shifts early on in the pull of the handle 60 placing the shuttle in the active position 56 during the majority, if not substantially all, of the revolution of the pulley 26. Preferably, as the shuttle 52 shifts toward the active position 56 and toward the housing passage 62, the start assist device 112 is also actuated such as closing a choke valve 114 of the carburetor 32. Regardless of whether the throttle control 42 is actuated or not, the shuttle 52 movement does not open the biased closed throttle valve 34.

As best illustrated in FIG. 3, this movement of the shuttle 52 from the rest to the active positions 54, 56 is represented by distance (X) and is about half the throw distance (2×) of the trigger 118 of the throttle control 42. If the throttle control 42 is appropriately not actuated (at idle) when the pull-cord 24 is pulled, the mid-segment 72 of the cable 50 will remain generally stationary and the cable tensioner 96 will separate from segment 72 creating cable slack at a moment in time when tension in the cable 50 is not needed. However, if the throttle control 42 of the throttle override device 40 is inadvertently actuated when the pull-cord 24 is pulled, the cable slack generally at the mid-segment 72 is taken-up by the trigger throw only through the control sheath 48, thus the throttle leg 104 of the cable 50 remains substantially stationary in the throttle sheath 46. The needed slack of cable 50 is about or slightly greater than (2×).

As best illustrated in FIG. 3 and for the purpose of further explaining movement of the cable 50 during various operating scenarios, the mid-segment 72 of the cable 50 is described as extending between a first connection point 106 that connects to a first or control leg 102 of the cable 50, and a second connection point 108 that connects to a second or throttle leg 104 of the cable 50. The control leg 102 engages to the throttle control 42 at one end and an opposite end projects through the opening 66 of the second control sheath 48 to connect to the mid-segment 72 at a connection point 106. The throttle leg 104 engages to the throttle valve 34 at one end and an opposite end projects through the opening 68 of the throttle sheath 46 to connect to the mid-segment 72 at the connection point 108.

During operation of a running engine, the shuttle 52 generally remains in the rest position 54. When the trigger 118 of the throttle control 42 is depressed to open the throttle valve 34 to accelerate the engine, the shuttle 52 remains in the rest position 54 and generally the mid segment 52 slides across the preferably substantially frictionless convex surface 100 of tensioner 96. The tensioner 96 is frictionless to a degree so as not to contribute excessive tension forces upon the control leg 102 of the cable 50 that would exceed the force of the tension spring 69 causing the shuttle 52 to substantially shift out of the rest position 54. When the shuttle 52 is functioning as a dampener, however, the cable 50 does not generally slide against the cable tensioner 96 but the shuttle 52 will slightly shift out of the rest position 54 in order for full depression of trigger 118 to the wide open position of the throttle valve 34. One skilled in the art would now know that the tensioner 96 can be journaled for rotation to the body 76 of the shuttle 52 to reduce the effects of friction upon the cable 50.

As best illustrated in the bottom portion of FIG. 3, when the engine is being started, the shuttle 52 shifts to the active position 56. If the trigger 118 is unduly depressed before pulling of the cord, the normally closed throttle valve will be undesirably moved off idle. However, once pulling begins of the pull-cord and the shuttle 52 shifts to the active position 56, the mid segment 72 of the cable 50 will generally follow the tensioner until the throttle valve rotates back to the biased closed or idle position by the biasing force of its own return spring. Preferably, when the shuttle 52 is fully in the active position, the cable 50 is slightly spaced from the tensioner 96 thus assuring the throttle valve has completely returned to the idle position. If the trigger 118 is not depressed, the mid segment 72 will not trail or move generally with the shuttle 52. Instead, the tensioner 96 will depart or move from the loop of the cable by a distance of about (X). Because of the structural relationship between the housing 30, bosses 80, 82, spindle 92 and shuttle body 76, the loop generally of the mid-segment 72 can remain stationary while the shuttle 52 is free to shift. One skilled in the art may now understand that the loop or mid-segment 72 and the cable tensioner 96 can be eliminated with the connection points or ends 106, 108 attached individually and directly to the body 76, however, the cable 50 must be able to produce the slack previously described without creating any resistance or obstruction of shuttle shifting.

A modified version of the throttle override device 40 is illustrated in FIGS. 5-6 with like components having like identifying numerals except followed by the prime symbol. In FIGS. 5-6, the pull-cord 24' is not counter wound to a shuttle of a throttle override device with respect to the pulley as previously presented. Instead, a single winding of the pull-cord 24' extends about both the shuttle 52' and the pulley 26' so that when a handle 60' of a recoil starter assembly 22' is pulled, the winding generally tightens about both the shuttle 52' and the pulley 26' creating a temporary frictional engagement between the two. The frictional interface between a radially inward facing surface of the shuttle 52' and an outward circumferential surface of the pulley 26' is induced or caused by a reactive force directed generally radially inward with respect to the pulley 26'. This force is produced by the looping of one of the windings 120 of the plurality of windings of the pull-cord 24' both over a reaction portion or spindle 92' of the shuttle 52' and the pulley 26'. The spindle 92' is disposed radially outward from the pulley 26' and is substantially centered axially with respect to the pulley over the pulley groove. A body 76' of the shuttle 52' houses the spindle 92' and opens radially inward so that any one winding 120 of the pull-cord 24' can be diverted from the pulley groove, as it is routed over the spindle 92' and then return back into the pulley groove.

The contour or profile of the spindle 92' preferably includes a circular valley or V-groove that axially centers and retains the pull-cord 24' on the spindle 92' of the shuttle 52'. A rotational axis of the spindle 92' is orientated substantially parallel to a rotation axis 28' of the pulley 26'. Pulling of the pull-cord 24' by the operator creates a tension in the pull-cord that biases the spindle 92' and shuttle 52' radially inward against the pulley 26'.

In operation, as shown in FIG. 6, when the shuttle 52' moves toward the active position 56' of the throttle override device 40', slack is created in the cable 50' so that if a throttle control 42' is inadvertently actuated (off idle), the throttle valve 34' will not move out of its biased idle position. Simultaneously, the shuttle 52' preferably actuates a start assist device 112' by pulling upon a relatively taught Bowden cable 110'. During the initial pull of the pull-cord 24' or during withdrawal of the first winding 120 from the housing 30', the shuttle 52' moves counter-clockwise with the pulley 26' and within a channel 122 in the housing due to the frictional interface engagement between the shuttle 52' and the pulley 26', and/or a force created by the orientation of the shuttle 52' with the particular winding generally disposed within the housing 30' and adjacent to a passage 62'. The shuttle 52' moves counter-clockwise until the shuttle 52' contacts the stop 88' carried by the housing 30' at which point the shuttle 52' is in the active position 56'.

The shuttle 52' moves a sufficient angular distance to actuate the throttle override device 22' and preferably the start assist device 112' via respective Bowden cables 44,' 110'. Both Bowden cables 44', 110' are preferably connected to a radially projecting arm 124 of the shuttle 52' that extends through a slot 126 of the housing 30'. With the shuttle 52' in the active position 56' or pressed against the stop 88', the remaining windings of the pull-cord 24' are withdrawn from the housing 30' by the operator's continuing pull on the handle 60' causing the pulley 26' to continue its rotation.

During this remaining or continuing pull, the frictional engagement of the shuttle 52' and the pulley 26' is overcome by the pulling force exerted upon the cord 24' by the operator. Therefore, the pulley 26' continues to rotate counter-clockwise as the pull-cord 24' is withdrawn from the housing 30' and as the shuttle 52' remains stationary. The circumferential location of the stop 88' generally lies within the range of ninety to one hundred and twenty degrees away and in a clockwise direction from the passage 62' which generally locates the channel 122 (i.e. shuttle travel range) diametrically opposite the passage 62'. This generally diametrically opposed orientation assures that the shuttle 52' does not become bound or entangled proximate to the passage 62' of the housing 30'.

When the pull-cord 24' is released, the clockwise rotation of the pulley 26' moves the shuttle 52' clockwise away from the stop 88' and toward the rest stop 84' carried by the housing 30' and that preferably defines the opposite end of the channel 122. Upon release of the pull-cord, the shuttle 52' and the remote start assist device automatically re-align themselves, wherein the bias force of the biasing member or tension spring 69' acts on the shuttle 52' moving the shuttle toward the rest stop 84' and creating a degree of slack within the Bowden cable 110' that can be taken-up by a biasing member or tensioner 128, as illustrated in FIG. 6.

The descriptions of all of the above-described embodiments and modified forms are incorporated by reference into one another.

While the forms of the invention herein disclosed constitute presently preferred embodiments, many others are possible. It is not intended herein to mention all the possible equivalent forms or ramifications of the invention. It is understood that terms used herein are merely descriptive, rather than limiting, and that various changes may be made without departing from the spirit or scope of the invention as defined by the following claims.

The invention claimed is:

1. A pull-cord start system for a combustion engine comprising:

a throttle valve of a carburetor constructed and arranged to move between an idle position and a wide open throttle position;

a housing;

a recoil pulley rotatably carried by the housing and coupled to a crankshaft of the engine;

a pull-cord constructed and arranged to wind about the recoil pulley, the pull-cord having a distal first end for engagement by an end user and a second end connected to the recoil pulley;

a throttle override device having a linkage operably connected between a throttle control and the throttle valve, and wherein the throttle override device is responsive to movement of the pull-cord to move with respect to the housing from a rest position to an active position upon actuation of the pull-cord wherein actuation of the throttle control by an end user will place the throttle valve in the open position when the throttle override device is in the rest position and will not open the throttle valve when the throttle override device is in the active position.

2. The pull-cord start system set forth in claim 1 further comprising a spring yieldably biasing the throttle override device to the rest position, and wherein the throttle valve is yieldably biased to its idle position.

3. The pull-cord start system set forth in claim 2 wherein the throttle override device has a shuttle slidably carried by the housing.

4. The pull-cord start system set forth in claim 3 further comprising:

a rotation axis about which the recoil pulley rotates;

the shuttle having a body slidably carried by the housing and a spindle aligned axially generally parallel to the axis of and spaced radially outward from the recoil pulley; and the pull-cord being at least partially wound about the spindle in a counter direction to the winding about the recoil pulley.

5. The pull-cord start system set forth in claim 4 wherein the spindle is journaled to the body for rotation.

6. The pull-cord start system set forth in claim 4 further comprising:

a boss engaged to the housing and projecting therefrom axially with respect to the rotation axis; and a slot in the body for receipt of the boss.

7. The pull-cord start system set forth in claim 6 wherein the slot extends linearly for linear movement of the shuttle.

8. The pull-cord start system set forth in claim 7 wherein the boss is one of two bosses spaced apart from one another in the slot.

9. The pull-cord start system set forth in claim 1 further comprising:

an auxiliary device;

a cable operably connecting the shuttle with the auxiliary device;

the pull-cord having a first winding and a last winding wound about the recoil pulley, the first end being adjacent the first winding and the second end being adjacent the last winding; and wherein unwinding of the first winding by a manual pull of the pull-cord by the end user causes the recoil pulley to rotate and a shuttle to move relative to the housing so that the shuttle actuates the auxiliary device when in the active position.

10. The pull-cord start system set forth in claim 9 further comprising:

the recoil pulley having a circumferential surface and a groove opening radially outward for receiving the pull-cord;

an opening between a portion of the housing and the circumferential surface; and the shuttle being disposed at least in-part in the opening.

11. The pull-cord start system set forth in claim 9 wherein the auxiliary device is a choke valve.

12. The pull-cord start system set forth in claim 1 wherein the throttle override device has a shuttle movable a distance (X) between a rest position and an active position, the throttle control has a trigger having a throw of a distance (2×) and the linkage comprises a cable having a slack length of about (2×).

13. A pull-cord start system for a combustion engine comprising:

a throttle valve of a carburetor constructed and arranged to move between an idle position and a wide open throttle position;

a housing;

a recoil pulley rotatably carried by the housing, coupled to a crankshaft of the engine and having a rotation axis about which the recoil pulley rotates;

a pull-cord constructed and arranged to wind about the recoil pulley, the pull-cord having a distal first end for engagement by an end user and a second end connected to the recoil pulley;

a throttle override device having a linkage operably connected between a throttle control and the throttle valve, and wherein the throttle override device is responsive to movement of the pull-cord to move with respect to the housing from a rest position to an active position upon actuation of the pull-cord wherein actuation of the throttle control by an end user will place the throttle valve in the open position when the throttle override device is in the rest position and will not open the throttle valve when the throttle override device is in the active position;

a spring yieldably biasing the throttle override device to the rest position, and wherein the throttle valve is yieldably biased to its idle position;

the throttle shuttle device having a shuttle having a body slidably carried by the housing and a spindle aligned axially generally parallel to the axis of and spaced radially outward from the recoil pulley;

the pull-cord being at least partially wound about the spindle in a counter direction to the winding about the recoil pulley; and the linkage has a cable operably connected between the throttle control and the throttle valve, and the cable has a mid-segment looped about a cable tensioner carried by the shuttle wherein movement of the shuttle selectively provides slack to the mid-segment for overriding throttle valve movement from the idle position.

14. The pull-cord start system set forth in claim 4 wherein the linkage comprises a Bowden cable having one unitary piece of flexible cable, a first stationary sleeve through which a first leg of the cable travels and a second stationary sleeve through which a second leg of the cable travels.

15. The pull-cord start system set forth in claim 14 wherein the cable of the Bowden cable has a mid segment extending between the first and second legs and wound partially about a tensioner projecting from the body.

16. The pull-cord start system set forth in claim 15 wherein the tensioner has a convex surface and the mid segment of the cable is in direct contact with the convex surface carried by the tensioner when the shuttle is in the rest position and spaced from the convex surface when the shuttle is in the active position and the throttle control is not actuated.

17. A pull-cord start system for a combustion engine comprising:

a recoil pulley biased into a retracted state;

a pull-cord wound about the pulley, the pull-cord having a distal first end for engagement by an end user and a second end connected to the recoil pulley;

a shuttle operably associated with the pull-cord and constructed and arranged to move between a rest position and an active position;

a throttle override device integrated into the shuttle and connected between a throttle control and a throttle valve of a carburetor for overriding the throttle control if actuated when the pull-cord is being pulled and while the shuttle is in the active position; and a start assist device integrated into the shuttle and actuated when the shuttle is in the active position.

18. The pull-cord start system set forth in claim 17 wherein the combustion engine is constructed and arranged to start when the throttle valve is in an idle position.

* * * * *